US009717327B2

(12) United States Patent
Papic et al.

(10) Patent No.: US 9,717,327 B2
(45) Date of Patent: Aug. 1, 2017

(54) CONSOLE FURNITURE AND FEATURES THEREOF

(71) Applicant: EVANS CONSOLES CORPORATION, Calgary, Alberta (CA)

(72) Inventors: Matko Papic, Calgary (CA); Richard Game, Calgary (CA); Carlos Renderos, Calgary (CA); Nathan Edward Stone, Calgary (CA)

(73) Assignee: Evans Consoles Corporation, Calgary (CA)

( * ) Notice: Subject to any disclaimer, the term of this patent is extended or adjusted under 35 U.S.C. 154(b) by 0 days.

(21) Appl. No.: 14/510,311

(22) Filed: Oct. 9, 2014

(65) Prior Publication Data

US 2015/0096472 A1 Apr. 9, 2015

Related U.S. Application Data

(60) Provisional application No. 61/888,723, filed on Oct. 9, 2013.

(51) Int. Cl.
*A47B 9/20* (2006.01)
*A47B 13/00* (2006.01)
(Continued)

(52) U.S. Cl.
CPC ..... *A47B 13/003* (2013.01); *A47B 9/20* (2013.01); *A47B 13/021* (2013.01); *A47B 21/02* (2013.01);
(Continued)

(58) Field of Classification Search
CPC ... A47B 9/20; A47B 13/06; A47B 2200/0051; A47B 2200/0052; A47B 57/42; A47B 96/061; A47B 83/001; E04B 2002/7483
(Continued)

(56) References Cited

U.S. PATENT DOCUMENTS 2,941,775 A * 6/1960 Arnit ..... A47B 57/425 248/243
2,983,389 A * 5/1961 Trautmann ..... A47B 37/00 108/102
(Continued)

FOREIGN PATENT DOCUMENTS

DE 9111216 U1 11/1991
DE 202010017975 U1 5/2013
(Continued)

OTHER PUBLICATIONS

European Patent Office, Partial European Search Report on Application No. 1418837.1, Issued on Feb. 6, 2015.
(Continued)

*Primary Examiner* — Janet M Wilkens
(74) *Attorney, Agent, or Firm* — Notaro, Michalos & Zaccaria P.C.

(57) ABSTRACT

The present disclosure is directed to console furniture and related features. A support structure is provided for supporting a work surface, the support structure comprising a frame defining an interior space, a frame brace receivable into the interior space of the frame, a support for supporting the work surface, and at least one fastening mechanism for extending between the frame brace and the support to clamp the frame therebetween, thereby securing the support about the frame. A console with a height adjustable work surface is also provided.

17 Claims, 22 Drawing Sheets

(51) Int. Cl.
*A47B 21/02* (2006.01)
*A47B 21/06* (2006.01)
*A47B 13/02* (2006.01)

(52) U.S. Cl.
CPC ..... *A47B 21/06* (2013.01); *A47B 2013/006* (2013.01)

(58) Field of Classification Search
USPC ..... 108/50.01, 50.02, 106–108, 147.17, 147; 312/223.3, 223.6, 194–196; 52/220.7, 52/36.1, 239; 248/188.1, 250, 243; 211/153
See application file for complete search history.

(56) References Cited

U.S. PATENT DOCUMENTS 2,998,107 A * 8/1961 Zimmerla ..... A47B 57/425 108/108
3,167,609 A * 1/1965 Brann ..... H02G 3/286 174/45 R
3,572,263 A * 3/1971 Propst ..... A47B 96/1416 108/108
3,983,823 A * 10/1976 McDonnell ..... A47F 5/10 108/107
4,660,477 A * 4/1987 Kortering ..... A47B 96/025 108/108
4,700,916 A * 10/1987 Bastian ..... A47B 57/42 211/192
4,785,742 A * 11/1988 Esslinger ..... A47B 17/02 108/101
4,895,331 A * 1/1990 Nehls ..... A47B 96/061 108/108
4,914,873 A * 4/1990 Newhouse ..... A47B 13/003 312/198
5,348,385 A * 9/1994 Berg ..... A47B 57/04 108/108
5,553,936 A * 9/1996 Dasher ..... F25D 25/02 248/243
5,598,789 A * 2/1997 Jonker ..... A47B 9/12 108/147
5,638,759 A * 6/1997 Klugkist ..... A47B 13/003 108/23
D399,683 S * 10/1998 Nicklas ..... D6/656.16
5,899,035 A * 5/1999 Waalkes ..... E04B 2/7433 211/192
6,047,838 A * 4/2000 Rindoks ..... A47B 96/1458 211/187
6,055,912 A * 5/2000 Doud ..... A47B 9/00 108/110
6,283,043 B1 * 9/2001 Stern ..... A47B 13/06 108/50.02
7,163,184 B2 1/2007 Nielsen
7,634,967 B1 * 12/2009 Albright ..... H02G 3/386 108/50.02
D623,445 S * 9/2010 Pai ..... D6/709
8,186,281 B2 * 5/2012 Bastian ..... A47B 21/06 108/50.02

FOREIGN PATENT DOCUMENTS

EP 0476315 A1 3/1992
FR 2665512 A1 2/1992
WO 2009/146708 A1 12/2009

OTHER PUBLICATIONS

European Patent Office, Extended European Search Report on Application 14188337.1, Issued on Jul. 6, 2015.
English Machine Translation of description and claims of DE Patent No. 91 11 216 U1, obtained from <worldwide.espacenet.com> on Feb. 29, 2016.
English Machine Translation of specification of EP Patent No. 0 476 315 A1, obtained from <worldwide.espacenet.com> on Feb. 29, 2016.
English Machine Translation of specification of FR 2 665 512 A1, obtained from <worldwide.espacenet.com> on Feb. 29, 2016.
English Machine Translation of specification of DE 20 2010 017975 U1, obtained from <worldwide.espacenet.com> on Feb. 29, 2016.

* cited by examiner

CONSOLE FURNITURE AND FEATURES THEREOF

CROSS-REFERENCE TO RELATED APPLICATION

This Application claims the benefit under 35 U.S.C. 119(e) of U.S. Provisional Application 61/888,723 filed Oct. 9, 2013, which is incorporated herein by reference in its entirety.

FIELD OF THE DISCLOSURE

The present disclosure relates to frameworks for supporting equipment or other objects, and in particular to consoles and related features.

BACKGROUND

Consoles are used in a variety of different applications, including in control rooms, on trading floors, and in operations centers. Consoles are typically used in the place of generic office equipment. Consoles may provide an enhanced human machine interface by allowing for the positioning of equipment in the more useful and efficient positions. Furthermore, consoles may be adapted to support more equipment compared to generic office equipment.

In addition, many traditional consoles struggle with changing user needs. Many existing technical furniture and consoles are custom manufactured, which in terms of design and construction is often both expensive and time consuming. This approach is usually necessitated by customer requirements that are often unique in terms of work station size, equipment placement, human engineering and cost considerations. In the result, the completed console structures are not only very expensive, but are usually also very difficult to subsequently modify for the reconfiguration of existing equipment or to retrofit new equipment.

Furthermore, many existing systems do not provide a low-cost solution that allows for a high degree of customization in terms of size, shape and layout of the consoles. In many instances, end users desire a console having custom physical dimensions and features. For example, a user may desire a console that is customized to fit a particular room layout. The room could have a curved or sloped wall, one or more support pillars, a multi-level floor, etc. In another example, a user may desire that the configuration of the console be tailored for a specific application, or to hold and support specific equipment. Many existing furniture systems and console systems come in one or a number of standard sizes and shapes in an attempt to provide a "best fit". However, such systems are generally not easily customizable in terms of size, shape or configuration.

SUMMARY

The present disclosure is directed to, in at least one aspect, a support structure for supporting a work surface, the support structure comprising a frame defining an interior space, a frame brace receivable into the interior space of the frame, a support for supporting the work surface, and at least one fastening mechanism for extending between the frame brace and the support to clamp the frame therebetween, thereby securing the support about the frame.

The present disclosure is directed to, in at least another aspect, a support structure for supporting a work surface, the support structure comprising two spaced apart leg frames, each leg frame defining an interior space, at least two support columns for supporting the work surface above the leg frames, each support column at least partially receivable into the interior space of a respective one of the leg frames, and at least one lift assembly for selectively raising and lowering the at least two support columns relative to the leg frames for adjusting the height of the work surface.

The present disclosure is directed to, in at least a further aspect, a support structure for supporting an object, the support structure comprising at least one leg frame having first and second ends and defining an interior space, the leg frame comprising at least one channel extending at least partially between the first and second ends, at least one alignment device receivable into the at least one channel and defining at least one mounting hole, wherein when the at least one alignment device is positioned within the channel, the at least one mounting hole may cooperate with mounting hardware to provide alignment of the object to be mounted about the leg frame with the leg frame

BRIEF DESCRIPTION OF THE DRAWINGS

The present disclosure will be better understood having regard to the drawings in which.

DETAILED DESCRIPTION

The present disclosure is described in several embodiments with reference to the Figures.

Figure 1A:
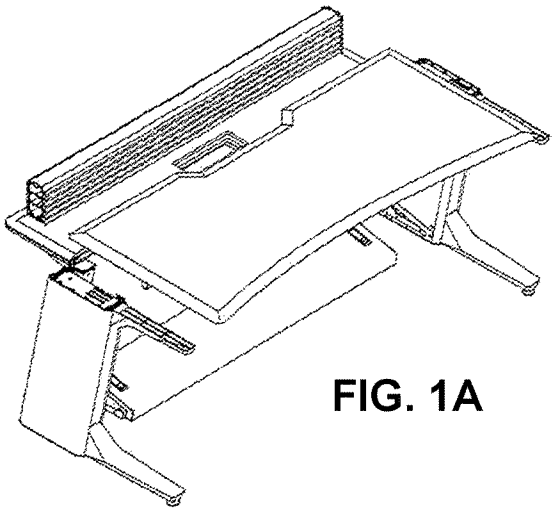
FIG. 1A is an exploded view of the support structure of the embodiment of FIG. 1.
Figure 2A:
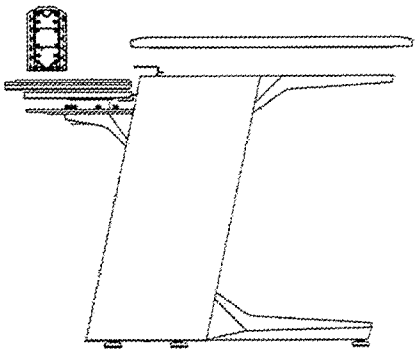
FIG. 2A is an exploded view of the support structure of the embodiment of FIG. 2.
Figure 1:
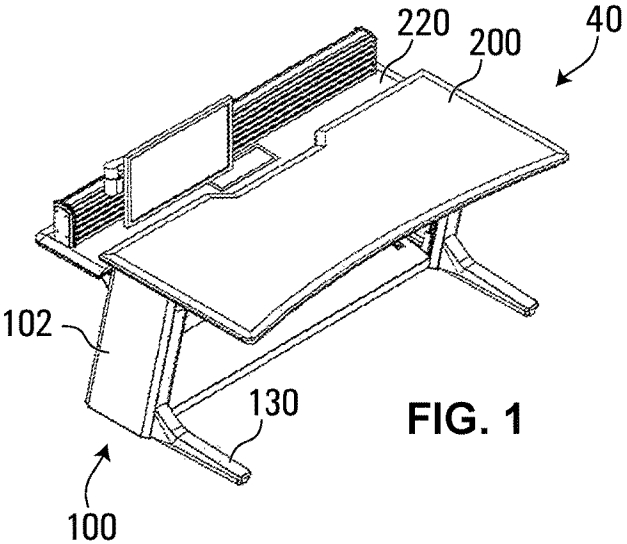
FIG. 1 is a front elevated perspective view of a first embodiment of a console according to the present disclosure.
Figure 2:
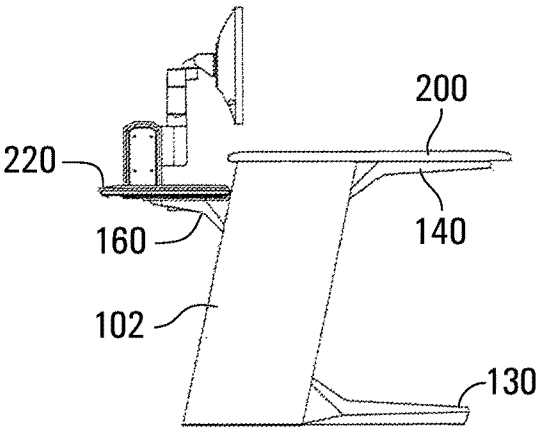
FIG. 2 is a side view of the embodiment of FIG. 1.

FIG. 1 shows a first embodiment of a console according to the present disclosure. Console 40 generally comprises a support structure 100 and one or more work surfaces, such as first and second work surfaces, 200 and 220, respectively. Support structure 100 may comprise a pair of spaced apart legs 102. Each leg 102 may have a foot 130 extending from a lower portion thereof for supporting the leg on a surface. As shown in FIG. 2, leg 102 may also have a first arm 140 extending from an upper portion thereof for supporting first work surface 200. In addition, leg 102 may have a second arm 160 that extends from leg 102 for supporting second work surface 220.

Figure 3:
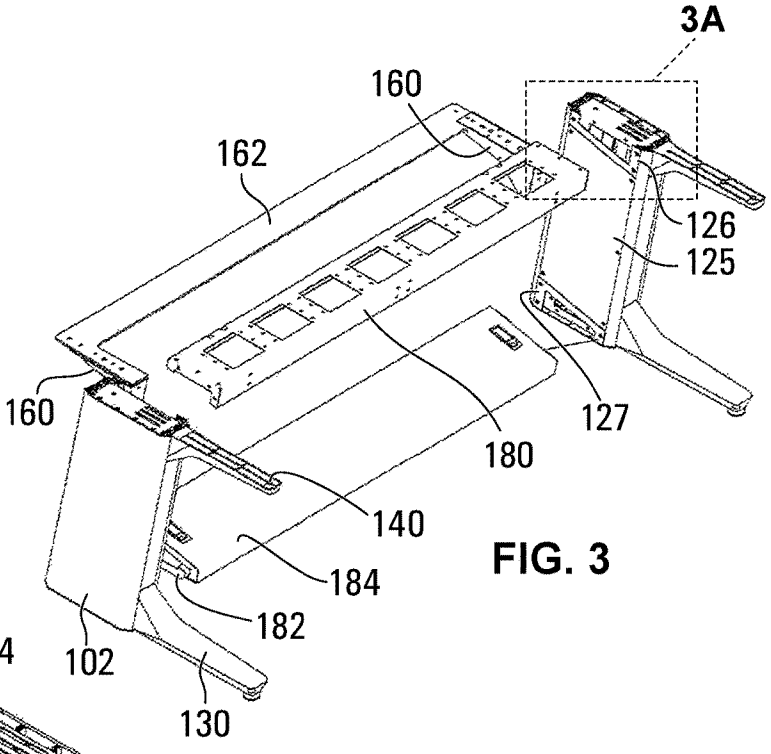
FIG. 3 is an exploded view of the support structure of the embodiment of FIG. 1.

As shown in an exploded view of support structure 100 shown in FIG. 3, the structure may have a second work surface support 162 extending between second arms 160. In addition, support structure 100 may have one or both of an upper cable raceway 180 and a lower cable raceway 182 extending between opposing legs 102. In at least one embodiment, upper and lower raceways may have the same or a similar shape and structure, although this is not required. Lower raceway 182 may have a cover 184 for protecting the contents of the raceway. In at least one embodiment, one or both of raceways 180 and 182 may extend the full length of support structure 100 and be connected to legs 102 in any suitable way, including by way of nuts and bolts (not shown).

Various components of the console may have one or more holes therein for interconnecting console components, attaching objects thereto, or for any other suitable purpose. In at least one embodiment, one or more of these holes may be fitted with a self-clinching nut (not shown). One type of self-clinching nut is a PEM™ self-clinching nut and is made by Penn Engineering™ which is headquartered in Danboro, Pa., U.S.A. This type of self-clinching nut is typically fitted to a hole by placing the nut at or in the hole and applying a press force to the head of the nut. The nut may then receive a bolt in the usual way.

Figure 5A:
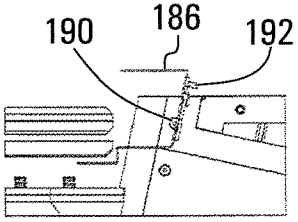
FIG. 5A is a close-up view of a pan assembly shown in FIG. 5.
Figure 5:
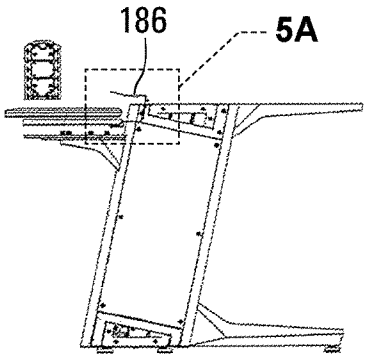
FIG. 5 is a side view of the inside of a console leg of the console of FIG. 1.
Figure 4:
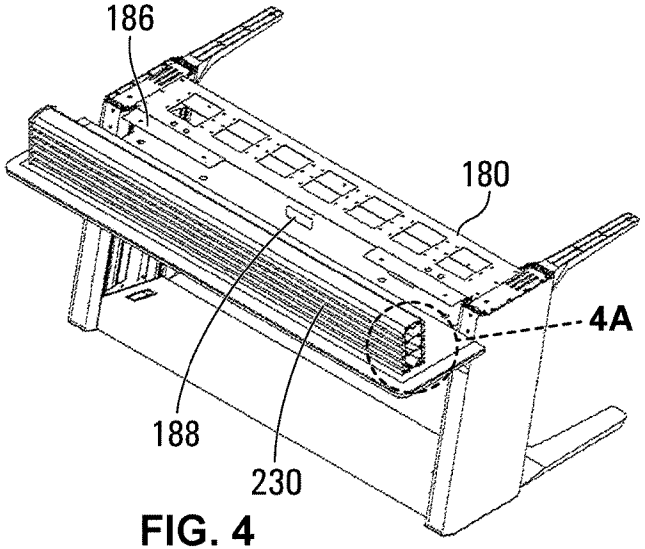
FIG. 4 is a rear elevated perspective view of the support structure of the console shown in FIG. 1.
Figure 4A:
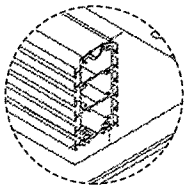
FIG. 4A is a close-up view of an end of a slatwall of FIG. 4.

In addition, as shown in FIGS. 4 and 5, support structure 100 may also comprise a wire pan assembly 186 to serve as a cabling entry point interface to the console. Wire pan assembly 186 may be fastened to or be an integral part of upper cable raceway 180, and may have one or more holes or openings 188 to, for example, allow for the passage of cabling therethrough, to receive one or more wiring boxes (e.g. power, data, etc.), or for any other suitable purpose. As shown in the close-up view of FIG. 5A, in at least one embodiment, wire pan assembly 186 may have one or more brush grommets 190 for covering the one or more holes 188. Such grommets 190 may be desirable when a hole 188 is used for the passaging of cabling. Brush grommets 190 may be retained in place by a bracket 192 or in any other suitable way.

Figure 7A:
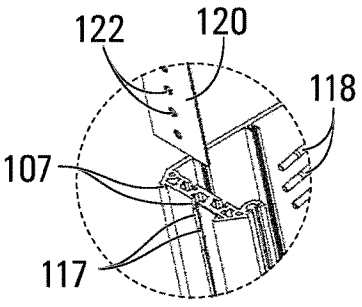
FIG. 7A is a close-up view of a top region of the leg frame shown in FIG. 7.
Figure 7:
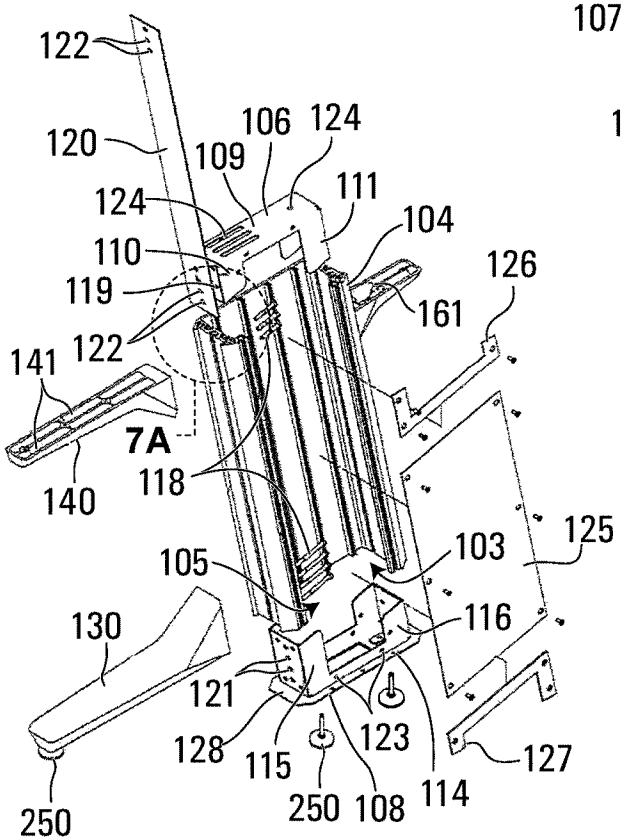
FIG. 7 is an exploded view of a console leg of the console of FIG. 1.
Figure 6:
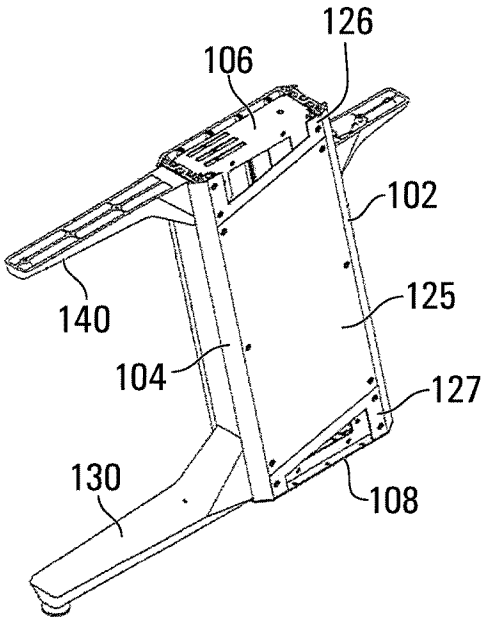
FIG. 6 is a side perspective view of the inside of a console leg of the console of FIG. 1.

The legs, feet and arms of support structure 100 are now described. FIG. 6 shows leg 102 in isolation. The side of leg 102 shown in this figure is, in one embodiment, an "inside" side of the leg, meaning the side that faces an opposing leg. FIG. 7 shows an exploded view of leg 102. Leg 102 comprises a leg frame 104, which in one embodiment may be a metal extrusion. Also, as shown in FIG. 7, in one embodiment leg frame 104 defines an interior space 103. One side 105 of leg frame 104 may be open, which may permit for easier access to the inside of the leg frame, for example for access to attachment hardware, such as nuts and bolts, during assembly, disassembly, and/or adjustments to the console. Interior space 103 of leg frame 104 may also allow for the passage of cabling or other wiring though the leg, for example from the floor or lower raceway 182 of the console to the upper region of console, for instance to equipment or upper cable raceway 180. In this sense, interior space 103 of leg frame 104 may be used as or otherwise house a cable raceway.

In at least one embodiment, leg frame 104 may comprise one or both of an upper frame brace 106 and a lower frame brace 108, each of which may be received into a respective upper end and lower end of leg frame 104. Upper frame brace 106 may have a base 109, and first and second arm portions 110 and 111, respectively, extending from base 109 for cooperation with inside surfaces of leg frame 104. In addition, upper frame brace 106 may define one or more holes, slots or other openings for receiving attachment or connection hardware. In at least one embodiment, upper frame brace 106 may be formed by folding or welding sheet metal into the desired shape. However, upper frame brace 106 may be may be made of any other suitable material and in any other suitable way.

Similarly, lower frame brace 108 may comprise a base 114, and first and second arm portions 115 and 116, respectively, extending from base 114 for cooperation with inside surfaces of leg frame 104. Lower frame brace 108 may also have a flange portion 128 extending from base 114, which when the brace is received fully into leg frame 104, may abut an outer peripheral surface of leg frame 104. Lower frame brace 108 may also define one or more holes, slots, or other openings for receiving attachment or connection hardware. In addition, in at least one embodiment, lower frame brace 108 may be formed by folding or welding sheet metal into the desired shape. However, lower frame brace 108 may be may be made of any other suitable material and in any other suitable way.

Foot 130 and first arm 140 may be connected to leg frame 104 in any suitable way. In at least one embodiment, as shown in the cross sectional view of support structure 100 provided in FIG. 8, one or both of foot 130 and first arm 140 may be connected to leg frame 104 by way of one or more fasteners 118, such as bolts.

In one embodiment, first arm 140 may be directly fastened to leg frame 104. As shown in FIG. 7A, leg frame 104 may define one or more mounting holes or slots 117 therethrough for receiving fastening hardware. In one embodiment, the one or more slots 117 may be continuous along at least part of the height of frame 104 to allow first arm 140 to be positioned at various different heights relative to leg frame 104. A fastener 118, such as a bolt, may be inserted through hole or slot 117 from the inside of leg frame 104 to engage first arm 140.

Figure 8:
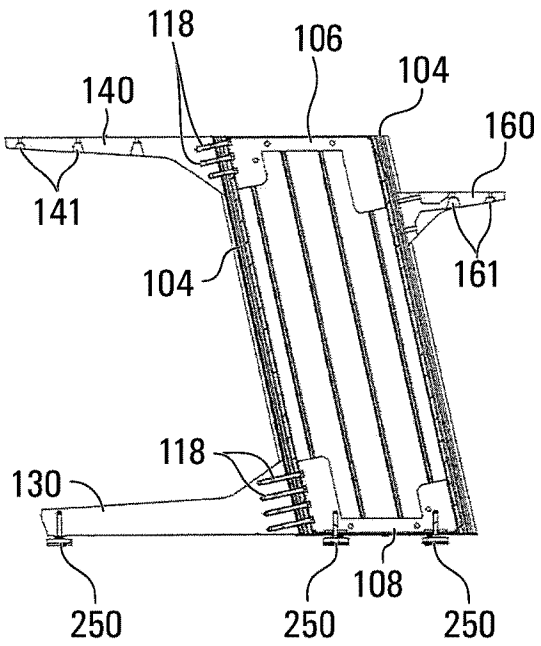
FIG. 8 is a cross sectional view of the console leg of the console shown in FIG. 1.
Figure 8A:
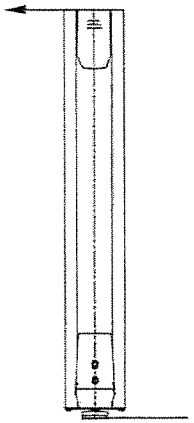
FIG. 8A is a console leg front view.
Figure 8B:
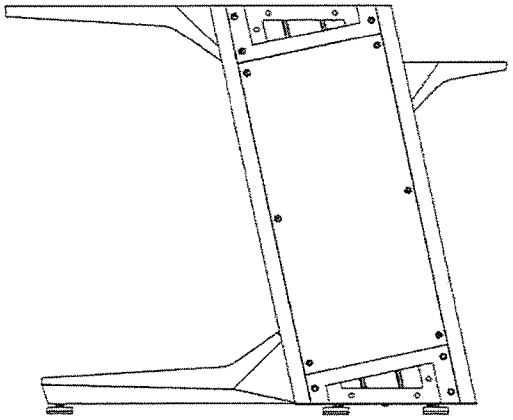
FIG. 8B is a console leg left side view.
Figure 8C:
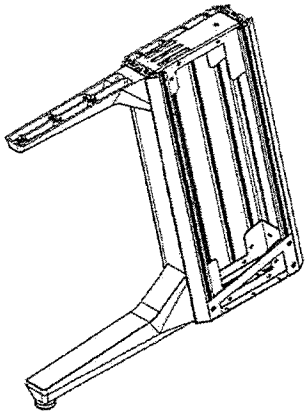
FIG. 8C is an isometric leg view.

In addition, in one embodiment, the one or more fasteners 118 may also engage upper frame brace 106 to effectively clamp leg frame 104 between brace 106 and first arm 140. This is shown in FIG. 8. Referring to FIG. 7, upper frame brace 106 may define one or more mounting holes or slots 119 for receiving one or more of the fasteners 118. As shown in FIG. 8, a fastener 118 may be inserted through hole 119 in upper frame brace 106 through hole 117 in leg frame 104 to engage first arm 140. Thus the one or more fasteners 118 may retain upper frame brace 106 and first arm 140 in position relative to leg frame 104.

Furthermore, in at least one embodiment as shown in FIG. 7, leg 102 may include an insert 120 positioned between first arm 140 and leg frame 104. Insert 120 may provide an aesthetic function, for example providing a visual scheme such as color or pattern to the console. Insert 120 may also have a structural function, for example enhancing the strength and rigidity of the console. Insert 120 may be made of any suitable material, including plastic, laminate, metal (e.g. stainless steel), etc.

In one embodiment, leg frame 104 may include structure to slidingly receive insert 120. For example, FIG. 7A shows leg frame 104 defining opposing slots 107. In addition, as shown in FIGS. 7 and 7A, insert 120 may define one or more holes or slots 122 therethrough for corresponding to the one or more mounting holes or slots 117 in leg frame 104. Thus when insert 120 is positioned at leg frame 104, the one or more fasteners 118 may be inserted through holes 117 in leg frame 104 through holes 122 in insert 120 to engage first arm 140. In an embodiment where leg frame 104 defines one or more continuous slots 117 to allow for the adjustment of the height of a support arm relative to leg frame 104, insert 120 may also define one or more continuous slots 122 that correspond to slots 117 in leg frame 104.

The above description of the various connections of first arm 140 to leg frame 104 may also apply to foot 130. Again referring to FIG. 7, leg frame 104 may define one or more holes or slots (not shown) in a lower portion of the frame for receiving one or more fasteners. In addition, in embodiments having lower frame brace 108, brace 108 may also define one or more holes or slots 121 therethrough. Therefore the one or more fasteners 118 may retain lower frame brace 108 and foot 130 in position relative to leg frame 104. Furthermore, in embodiments having insert 120, the insert may define one or more holes or slots 122 therethrough in a lower portion of the insert for receiving fasteners 118.

Again, an assembled embodiment of leg 102 with first arm 140 and foot 130 fastened to leg frame 104 is shown in FIG. 8.

Furthermore, as shown in the Figures, in at least one embodiment support structure 100 may comprise one or more second arms 160 extending from an opposite side of leg 102 than first support arm 140. One or more second support arms 160 may be connectable to leg frame 104 in any suitable way, including the ways described above in relation to first support arm 140. The structure of various components for the connection of second support arm 160 to leg frame 104 may also be similar or the same as described above in relation to first arm 140.

In addition, leg 102 may also comprise one or more covers or plates. Referring to FIGS. 6 and 7, leg 102 may include one or more of a main cover 125, an upper cover 126, and a lower cover 127. Upper cover 126 may be shaped to contour the profile of upper cable raceway 180, which may be connected to the top portion of leg 102. Similarly, lower cover 127 may be shaped to contour the profile of lower cable raceway 182, which may be connected to the lower portion of leg 102. The corresponding shapes of the raceways and upper and lower covers are shown in FIG. 3. The main cover 125 may, for example, comprise sheet metal. The upper cover 126 and lower cover 127 may, for example, comprise steel.

Furthermore, first work surface 200 and second work surface 220 may be secured to support structure 100 in any suitable way. For example, first work surface 200 may be secured to first arms 140. In one embodiment, first work surface 200 may be secured to first arms 140 by way of one or more fasteners (not shown) that are inserted through holes or slots 141 (see FIGS. 7 and 8) in first arms 140 to engage an underside of first work surface 200. Second work surface 220 may be secured to second arms 160 in a similar manner. Mounting holes 161 in second arm 160 are also shown in FIGS. 7 and 8.

Figure 3A:
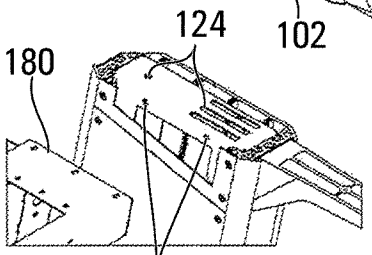
FIG. 3A is a close-up view of a top region of a console leg shown in FIG. 3.
Figure 3B:
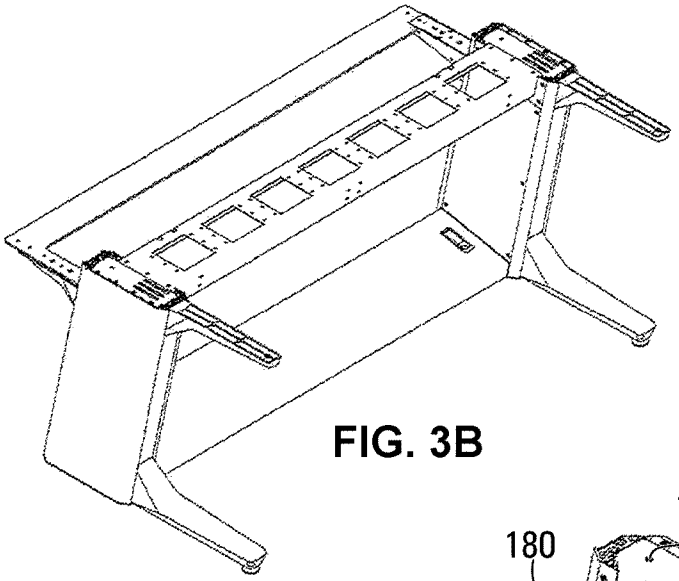
FIG. 3B is a front elevated perspective view of the view of the support structure of the embodiment of FIG. 3.

Furthermore, first work surface 200 may be secured to upper frame braces 106 in addition to or instead of being connected to first arms 140. As shown in FIG. 3A, upper frame brace 106 may define mounting holes or slots 124 therein for receiving attachment hardware to secure first work surface 200 to upper frame brace 106. In addition, upper cable raceway 180 may be mounted to the underside of upper work surface 200.

In one or more embodiments, as shown in FIG. 3, a second work surface support 162 may be positioned between second arms 160 and second work surface 220.

In addition, referring to FIG. 4, second work surface 220 may comprise or consist of a slatwall structure 230. In one embodiment, slatwall 230 may be secured about an upper surface of second work surface 220. In another embodiment, slatwall structure 230 may be directly secured to second arms 160 or to second work surface support 162. Other configurations are possible. In use, objects including display screens and other equipment may be supported on or from slatwall 230.

As shown in FIG. 3A, upper frame brace 106 may define one or more mounting holes 123 for connection to upper raceway 180. Similarly, as shown in FIG. 7, lower frame brace 108 may define one or more mounting holes or slots 123 for connection to lower raceway 182.

Foot 130, first arm 140 and second arm 160 may be made of any suitable material(s), including metal and metal alloys, including aluminum and aluminum alloy, and may be made in any suitable way, including by machining and/or casting.

In addition, as shown in FIG. 8, support structure 100 may comprise one or more adjustable levelers 250. One or more levelers 250 may be positioned at a bottom side of one or both legs 102 and one or both feet 130.

Another embodiment 50 of a console according to the present disclosure is shown in FIG. 9A to FIG. 12.

Console 50 has several similarities to the embodiments shown in FIGS. 1 to 8. Having reference to FIGS. 9A and 9C, console 50 comprises support structure 300 and may include one or more work surfaces, such as first work surface 400. Support structure 300 may comprise a pair of spaced apart legs 302 and one or more frame stringers 310 (see FIG. 10B) extending between legs 302. One or more frame stringers 310 may be of any suitable shape and form, including for example a metal extrusion. One or more legs 302 may include a foot 330 extending from a lower portion of the leg. Support structure 300 may also have one or more first arms 340 extending from an upper portion of the support structure for supporting first work surface 400.

First work surface 400 may comprise a front nosing 404 disposed along its front edge. In addition, first work surface 400 may support one or more slat rail assemblies 432. Slat rail assembly 432 in at least one embodiment is shown in more detail in FIG. 12. Assembly 432 may comprise a slat rail 434 supported about a work surface 402 by one or more posts 436. Work surface 402 is shown as being smaller than work surface 400, but slat rail assembly may be used in combination with any suitable work surface, including work surfaces 400 and 410 (shown in FIG. 10A).

One or both of slat rail 434 and posts 436 may be formed of an extruded material, such as aluminum or steel, although this is not necessary.

Slat rail 434 may include an insert filler strip 435 as well as end caps 437. Insert filler strip 435 may have one or more aesthetic functions, for example to hide bolts or other hardware, or to act as a color accent. Posts 436 may be secured to work surface 402 in any suitable way, for example by using post bases 438. A post 436 may be secured to post base 438, and thus to work surface 402, by way of an L-shaped bracket 439. In at least one embodiment, base 438 and bracket 439 may be formed as a single piece, for example a piece cast out of metal such as aluminum.

In addition, slat rail assembly 432 may comprise one or more of post covers 440, 441, post filler strip 442, post side filler strips 443, and top cap 444.

Furthermore, slat rail assembly 432 may include a cable raceway 445, which may be connected to a back side of slat rail 434 or posts 436 in any suitable way, including for example by way nuts and bolts (not shown). In addition, an open side of raceway 445 may be covered with a raceway cover 447, which may connect to raceway 445 by way of one or more mounting clips 446.

Figure 10A:
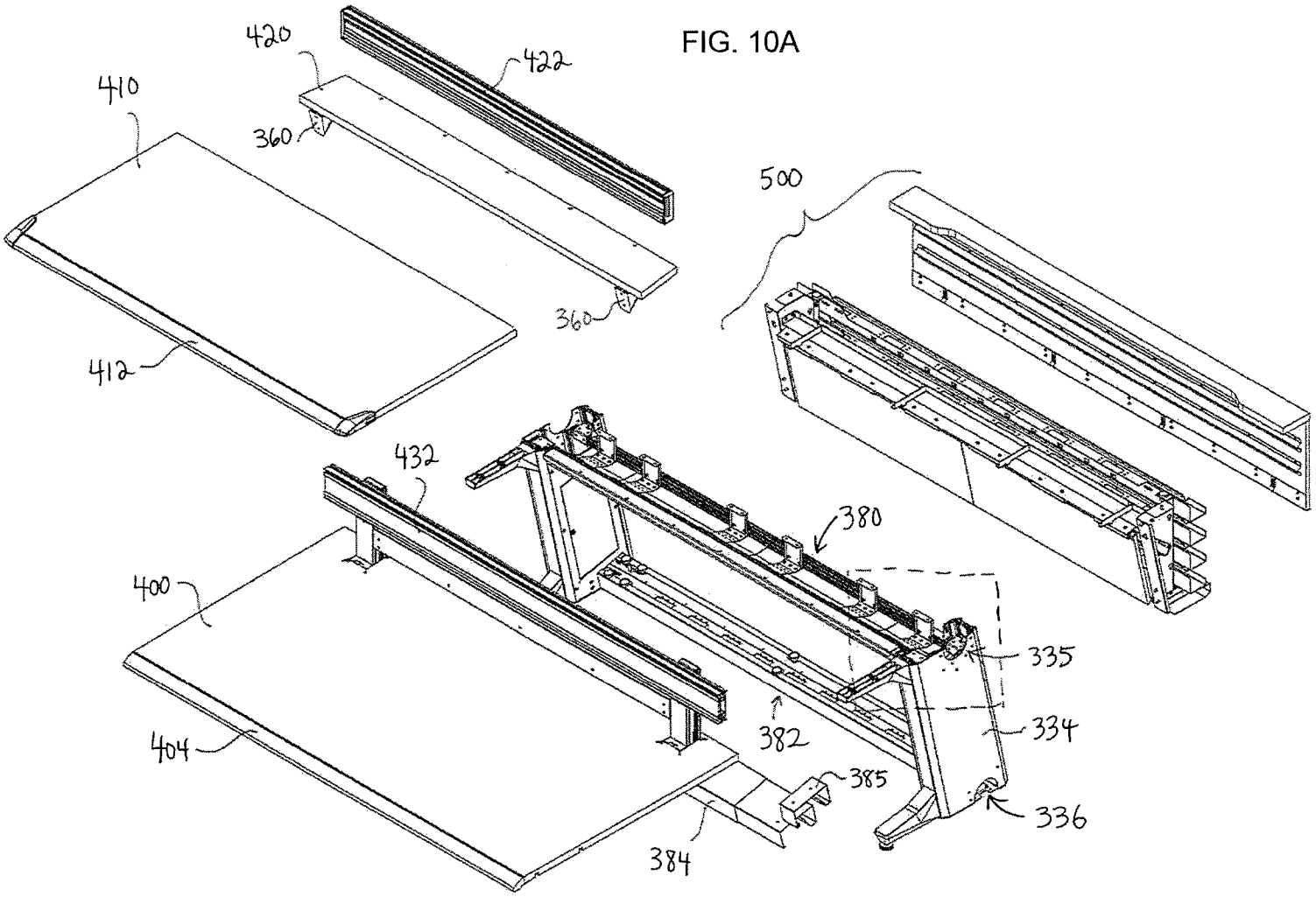
FIG. 10A is an exploded view of the console shown in FIG. 9A also showing some other possible work surfaces.

FIG. 10A shows some other options for work surfaces not shown in the other Figures. For example, support structure 300 may comprise one or more second arms 360 extending from an opposite side of leg 302 relative to first work surface 400 for supporting a second work surface 420. Second work surface 420 may support a slat rail structure 422, which may be used to support one or more displays or other equipment (not shown). Furthermore, in at least one embodiment, console 50 may include a third work surface 410 in place of work surface 400. Unlike first work surface 400, third work surface 410 may not be configured to support a slat rail. Thus in one embodiment, third work surface 410 may be used in combination with second work surface 420, which comprises slat rail 422. Work surface 410 may include front nosing 412, which may wrap around one or both front corners.

As also shown in FIG. 10A, support structure 300 may have one or cable raceways, such as an upper cable raceway 380 and a lower cable raceway 382 extending between opposing legs 302. Lower raceway 382 may have a foot cover 384 for protecting the contents of the raceway as well as one or more end covers 385. In at least one embodiment, one or both of raceways 380 and 382 may extend the full length of support structure 300 and be connected to legs 302 in any suitable way, including by way of nuts and bolts (not shown).

The legs, feet and arms of support structure 300 are now described with reference to FIGS. 11A and 11B. Similar to the embodiment shown in FIGS. 6 and 7, leg 302 comprises a leg frame 304, which in one embodiment may be a metal extrusion. Leg frame 304 may define an interior space 303. One side 305 of leg frame 304 may be open, which may permit for easier access to the inside of the leg frame, for example for access to attachment hardware or other objects in the leg.

Figure 10B:
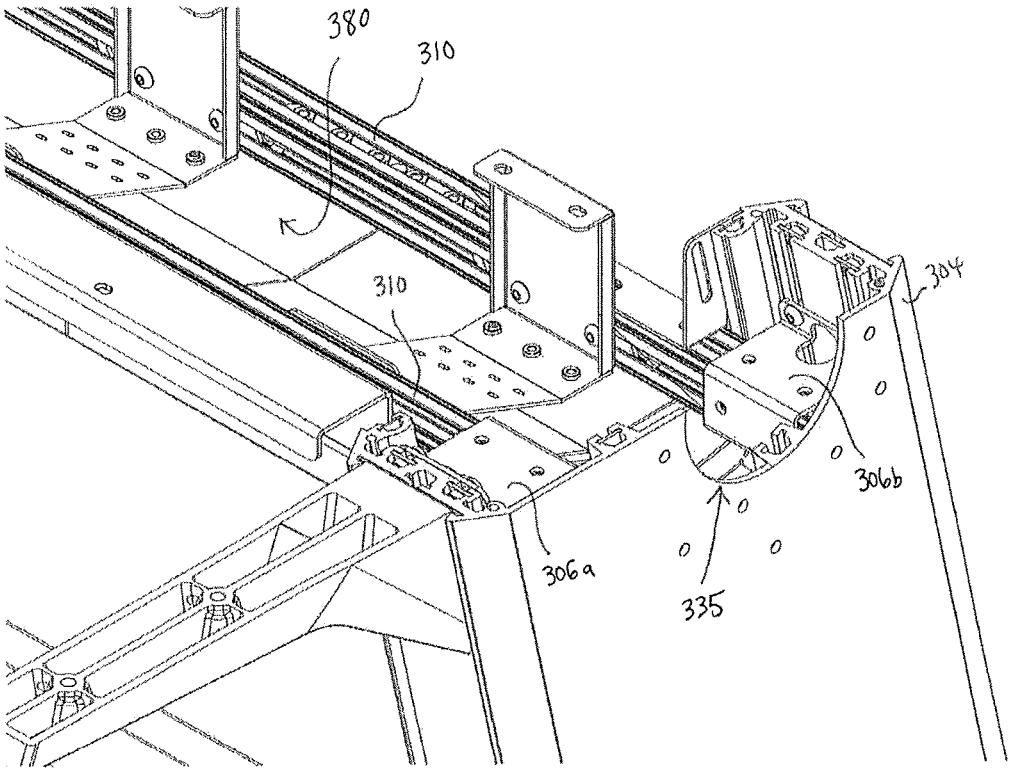
FIG. 10B is a close-up view of an upper corner region of the support structure of the console shown in FIG. 10A.

In contrast to the embodiment shown in FIGS. 6 and 7, in at least one embodiment, leg 302 may comprise one or more of frame stringer brackets 306*a* and 306*b*, and lower cable raceway brackets 308*a* and 308*b*, each of which may be received into a respective upper end and lower end of leg frame 304. Frame stringer brackets 306*a* and 306*b* may be securable at opposing inner sides of leg frame 304, as shown in FIGS. 10B and 11A, and may connect one or more frame stringers 310 to leg frame 304.

In a similar fashion, lower cable raceway brackets 308*a* and 308*b* may be securable at opposing inner sides of leg frame 304. Each of lower cable raceway brackets 308*a* and 308*b* may define one or more holes, slots or other openings for receiving attachment or connection hardware for attaching an end of a cable raceway. In addition, lower raceway brackets 308*a* and 308*b* may be formed in any suitable way, including by folding or welding sheet metal into the desired shape.

Leg frame 304 may also comprise one or more of first and second leveler base plates 314*a* and 314*b* disposed at its lower end for securing levelers 450.

Foot 330 and first arm 340 may be connected to leg 302 in any suitable way. In at least one embodiment, one or both of foot 330 and first arm 340 may be connected to leg frame 304 by way of one or more fasteners 318, such as bolts, in a similar way as in the embodiment shown in FIG. 8.

In particular, first arm 340 may be directly fastened to leg frame 304. Leg frame 304 may define one or more mounting holes or slots therethrough (not shown) similar to the holes 117 in the embodiment shown in FIG. 7A for receiving fastening hardware. The one or more slots may be continuous along at least part of the height of frame 304 to allow first arm 340 to be positioned various different heights relative to leg frame 304. A fastener 318, such as a bolt, may be inserted through the hole or slot from the inside of leg frame 304 to engage and secure first arm 340.

Figure 11B:
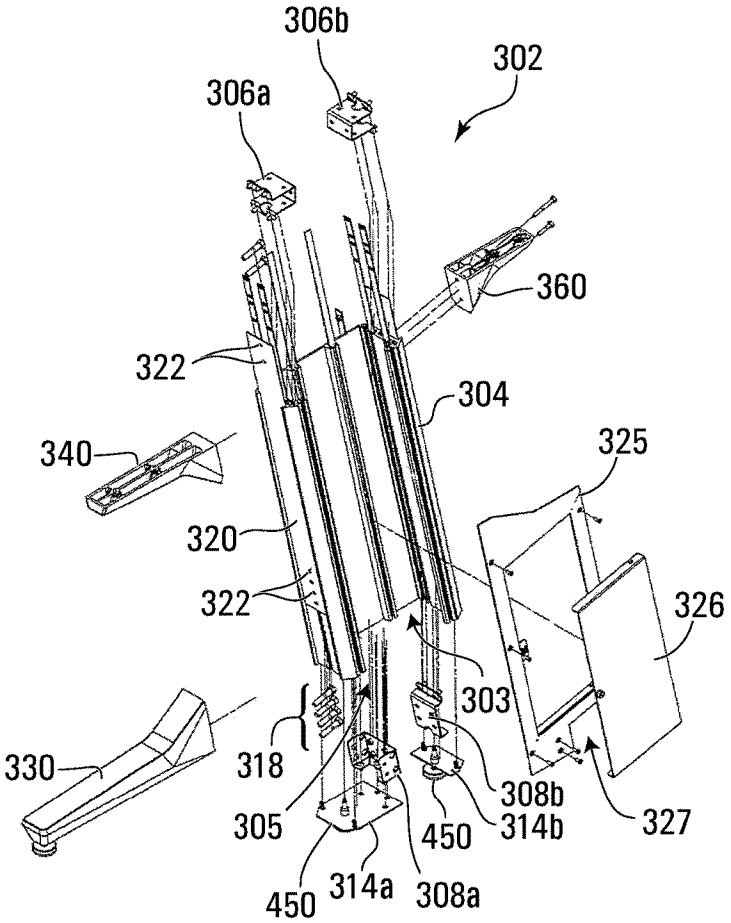
FIG. 11B is an exploded view of the console leg shown in FIG. 11A.
Figure 11A:
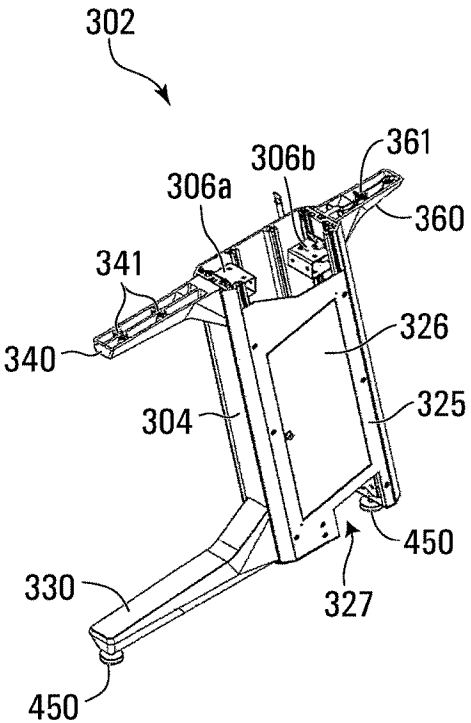
FIG. 11A is a side perspective view of the inside of a console leg of a console similar to the one shown FIG. 9A.
Figure 11C:
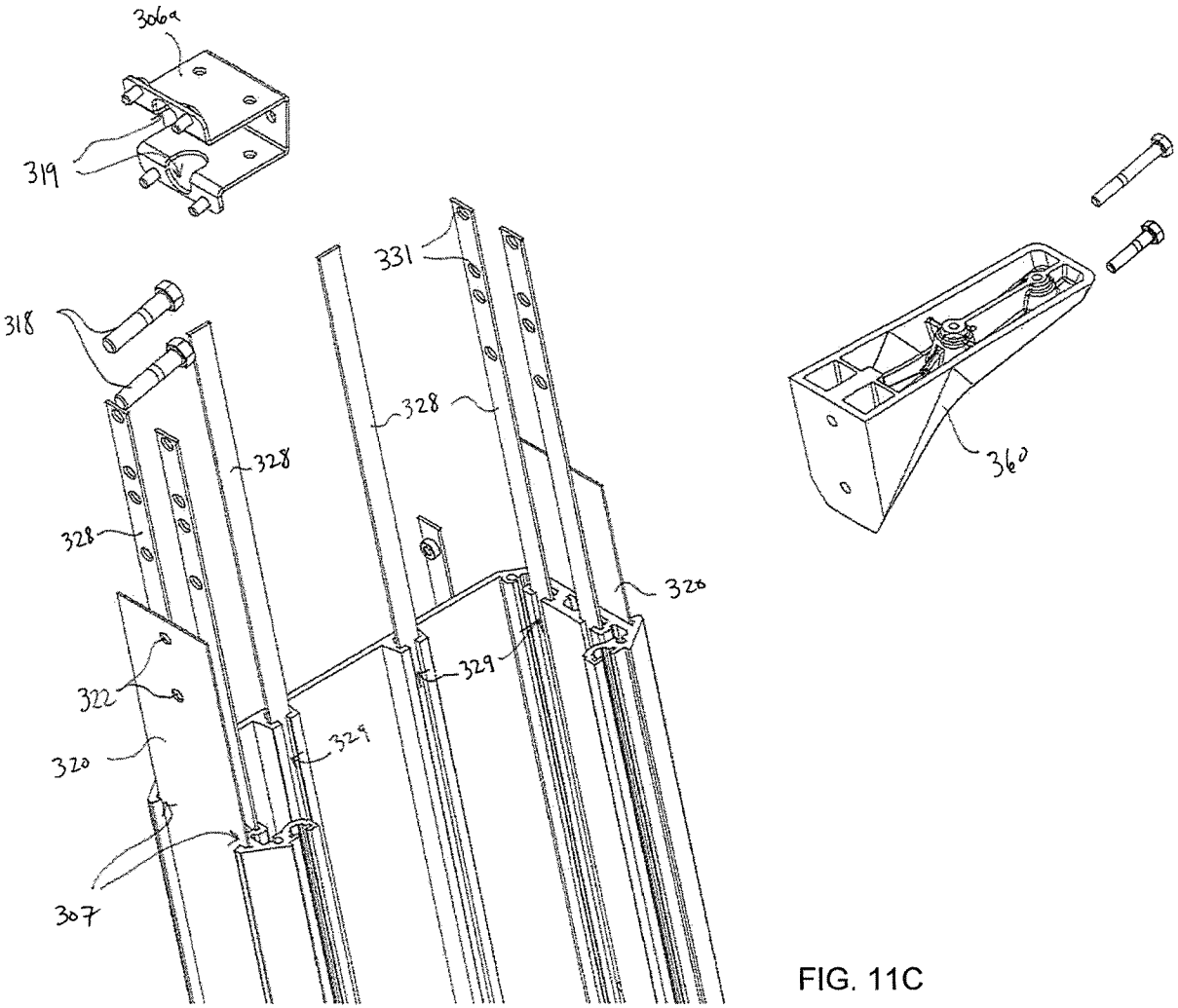
FIG. 11C is a close-up exploded view of an upper region of the console leg shown in FIG. 11A.
Figure 12:
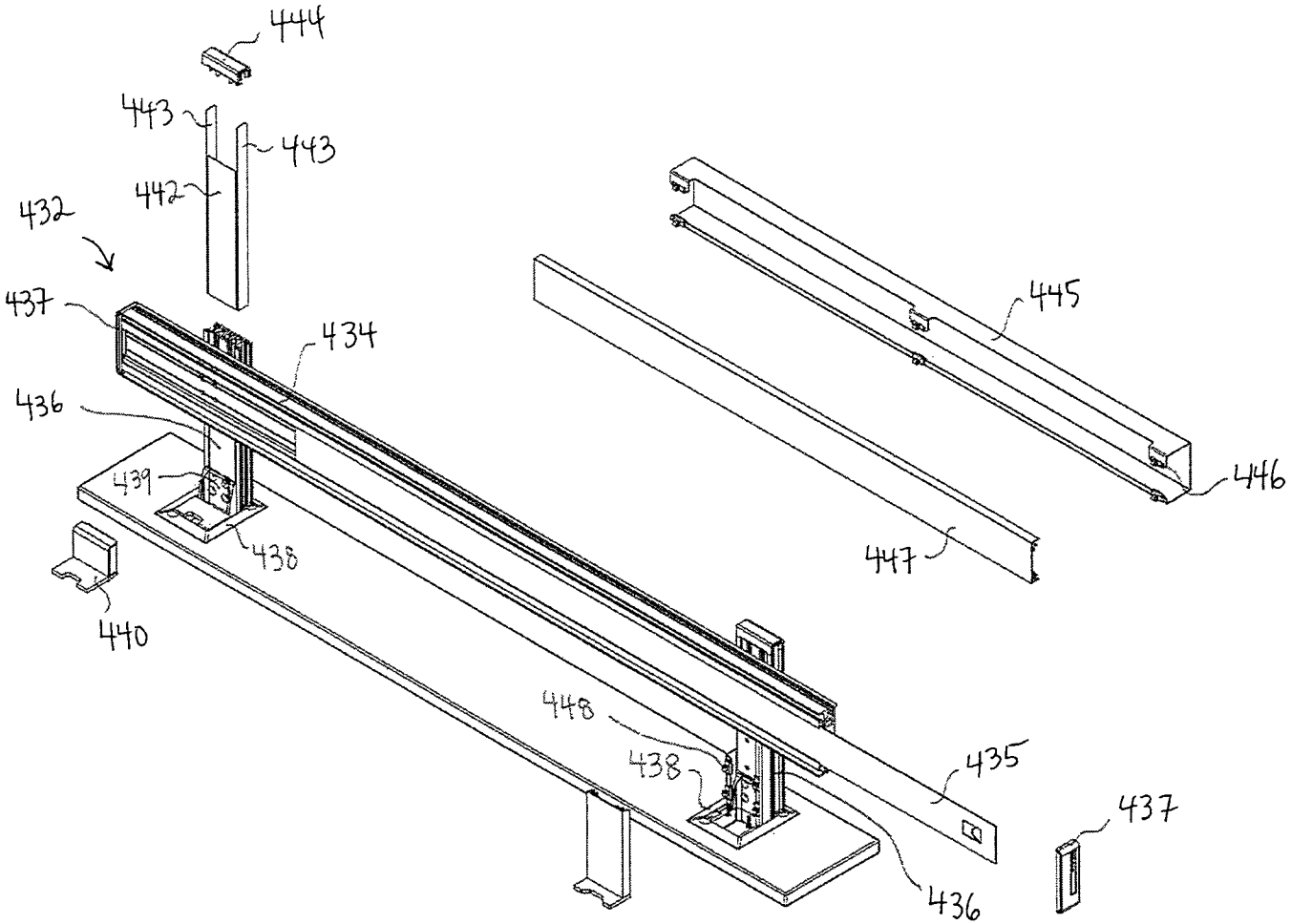
FIG. 12 is an exploded view of a slat rail assembly of the console shown in FIG. 9.

However, in one embodiment as shown best in FIGS. 11B and 11C, unlike the embodiment shown in FIGS. 6 and 7, the one or more fasteners 318 may not engage frame stringer brackets 306*a*, 306*b*. Frame stringer brackets 306*a* and 306*b* may define one or more recessed portions 319 for providing clearance for ends of one or more bolts 318.

Furthermore, leg 302 may include one or more inserts 320 positioned between first arm 340 and leg frame 304. Insert 320 may provide an aesthetic function. Insert 320 may also have a structural function, for example enhancing the strength and rigidity of the console. Insert 320 may be made of any suitable material, including plastic, laminate, metal, etc. In one embodiment, leg frame 304 may include structure to slidingly receive insert 320. FIG. 11C shows leg frame 304 defining opposing slots 307. Insert 320 may define one or more holes or slots 322 therethrough that correspond to the one or more mounting holes or slots in leg frame 304. Therefore when insert 320 is positioned at leg frame 304, the one or more fasteners 318 may be inserted through the one or more holes in leg frame 304 through holes 322 in insert 320 to engage first arm 340. In an embodiment where leg frame 304 defines one or more continuous slots (not shown) instead or in addition to holes 322 to allow for the adjustment of the height of a support arm relative to leg frame 304, insert 320 may also define one or more continuous slots that correspond to slots in leg frame 304.

The above description of the various connections of first arm 340 to leg frame 304 may also apply to foot 330 in at least some embodiments.

Furthermore, leg frame 304 may comprise one or more mounting or alignment device, such as strips 328, as shown in FIGS. 11B and 11C, for mounting or securing objects to or within leg frame 304. Each strip may be receivable into a strip channel 329 defined on or otherwise located at an interior side of leg frame 304 and may be retained in position in any suitable way, for example friction fit. One or more strips 328 may rest on or otherwise contact a surface in a lower region of leg frame 304, such as one of base plates 314*a*, 314*b* (FIG. 11B), or lower cable raceway 382 (FIG. 10A).

Strips 328 may define one or more holes, slots 331 or other structure for receiving one or more fasteners, for example to secure one or more of frame stringer brackets 306*a*, 306*b* and lower cable raceway brackets 308*a* and 308*b* to leg frame 304. One or more strips 328 may be used for precise alignment of one or more brackets 306*a* or 306*b* or for one or more of support arms 340 or 360. For example, a strip 328 may be installed into leg frame 304, for example so that a bottom side of strip 328 contacts a lower surface of leg frame 304 as described above. The position of one or more holes or slots 331 in strip 328 may then provide for precise positioning of other hardware relative to leg frame 304. For example, the location of a hole 331 in strip 328 may provide for a desired vertical positioning of hardware, such as a support arm or raceway mounting bracket, about the leg frame 304. For instance, a bolt or other fastener for securing a support arm may be received into the hole, thereby providing desired vertical positioning of the support arm about leg frame 304. In addition, strips 328 may be used for mounting or securing other hardware or device about leg frame 304, for example power bars, lift column mounting brackets, or electric patch panels. The mounting of hardware utilizing strip 328 may also act to restrain strip 328 in position relative leg frame 304.

Although strips 328 are shown to have a strip or flat shape, this is not meant to be limiting. Strips may have any other suitable shape, including for example circular, oval, or square cross sections. Furthermore, although leg frame 304 is described as defining one or more channels 329 for receiving strips 328, this also is not meant to be limiting. Leg frame 304 may include other or additional structure to receive and retain strips 328, for example brackets, hooks, eyelets, etc.

Leg 302 may also comprise one or more covers or plates. Referring to FIGS. 11A and 11C, leg 302 may include a cover 325, which may be positioned on the inner facing side of leg 302, meaning a side of the leg that faces the opposite leg of support structure 300. Cover 325 may define a lower cut-out portion 327 for allowing the passage of cabling from lower raceway 382. Cover may also comprise a removable panel or door 326 to provide access to interior space 303 of the leg frame 304.

Figure 9A:
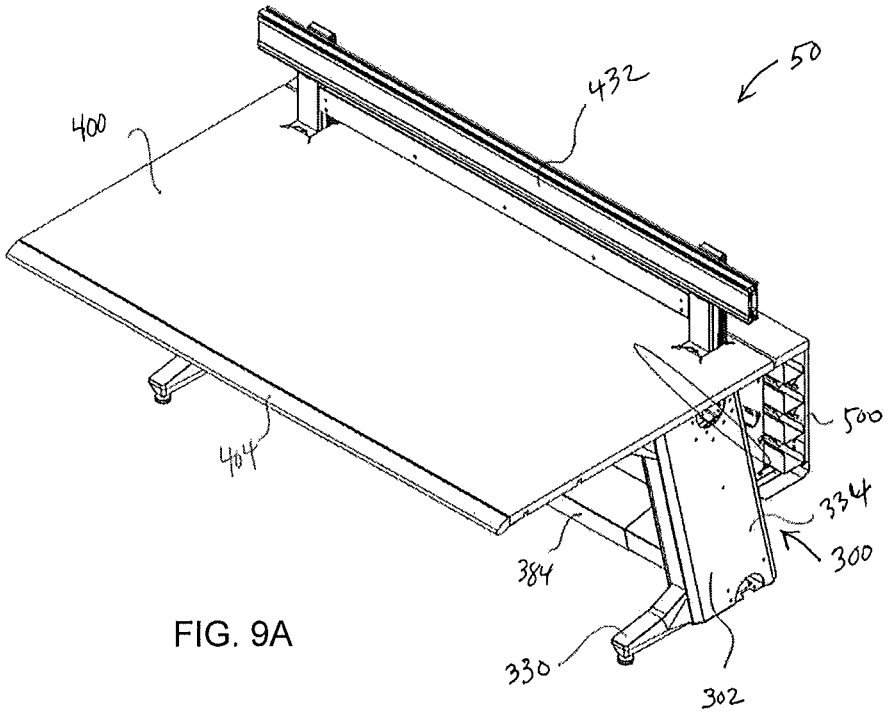
FIG. 9A is a front elevated perspective view of a second embodiment of a console according to the present disclosure.
Figure 9C:
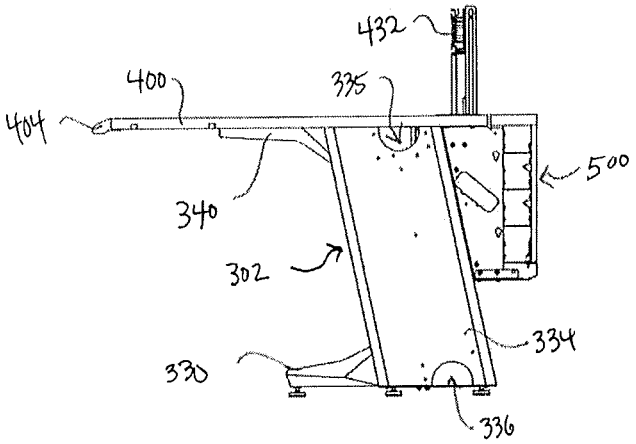
FIG. 9C is a side view of the console shown in FIG. 9A.
Figure 9B:
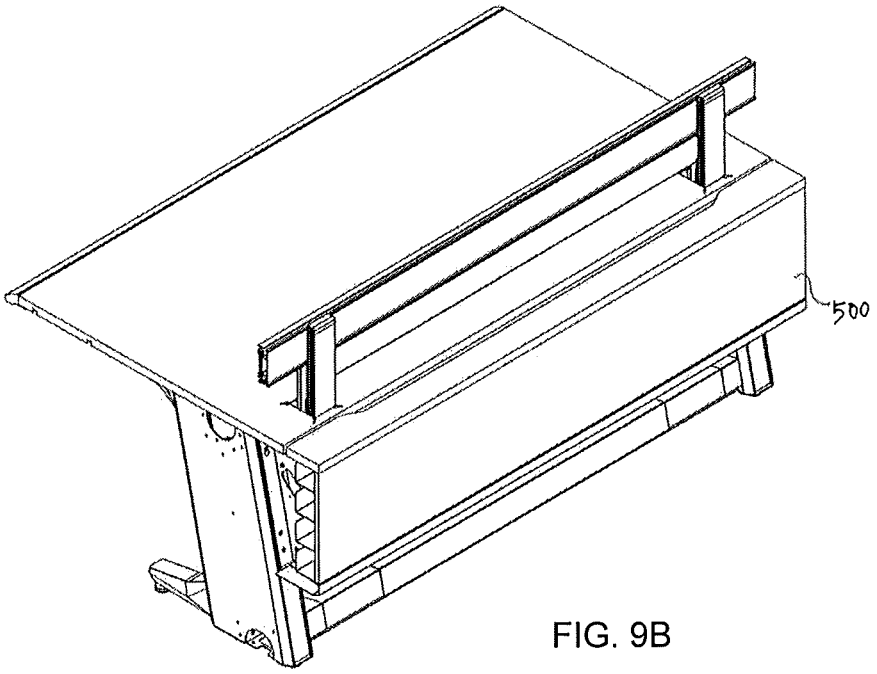
FIG. 9B is a rear elevated perspective view of the console shown in FIG. 9A.
Figure 9D:
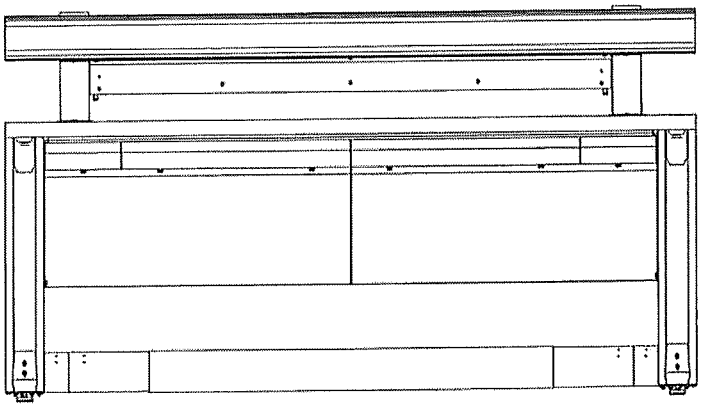
FIG. 9D is a rear view of the console shown in FIG. 9A.

Leg 302 may further comprise an outer cover 334, as shown in FIGS. 9A, 9C and 10A. Cover 334 may define one or more cut-outs, such as upper and lower cut-outs 335 and 336 (see FIG. 9C), respectively, for example to allow cabling to pass between two or more adjacent consoles.

Having reference to FIGS. 9C and 10, first work surface 400 may be at least partially supported about support structure 300 by way of first arms 340. First work surface 400 may be secured to first arms 340 in any suitable way, including by way of one or more fasteners (not shown) inserted through holes or slots 341 in first arms 340 (shown in FIG. 11A) to engage an underside of first work surface 400. Second and third work surfaces 420, 410, when present, may be secured to second arms 360 in a similar manner. Mounting holes 361 in second arm 360 are also shown in FIG. 11A.

One or more second support arms 360 may be connectable to leg frame 304 in any suitable way, including the ways described above in relation to first support arm 340. The structure of various components for the connection of second support arm 360 to leg frame 304 may also be similar or the same as described above in relation to first arm 340.

Figure 13:
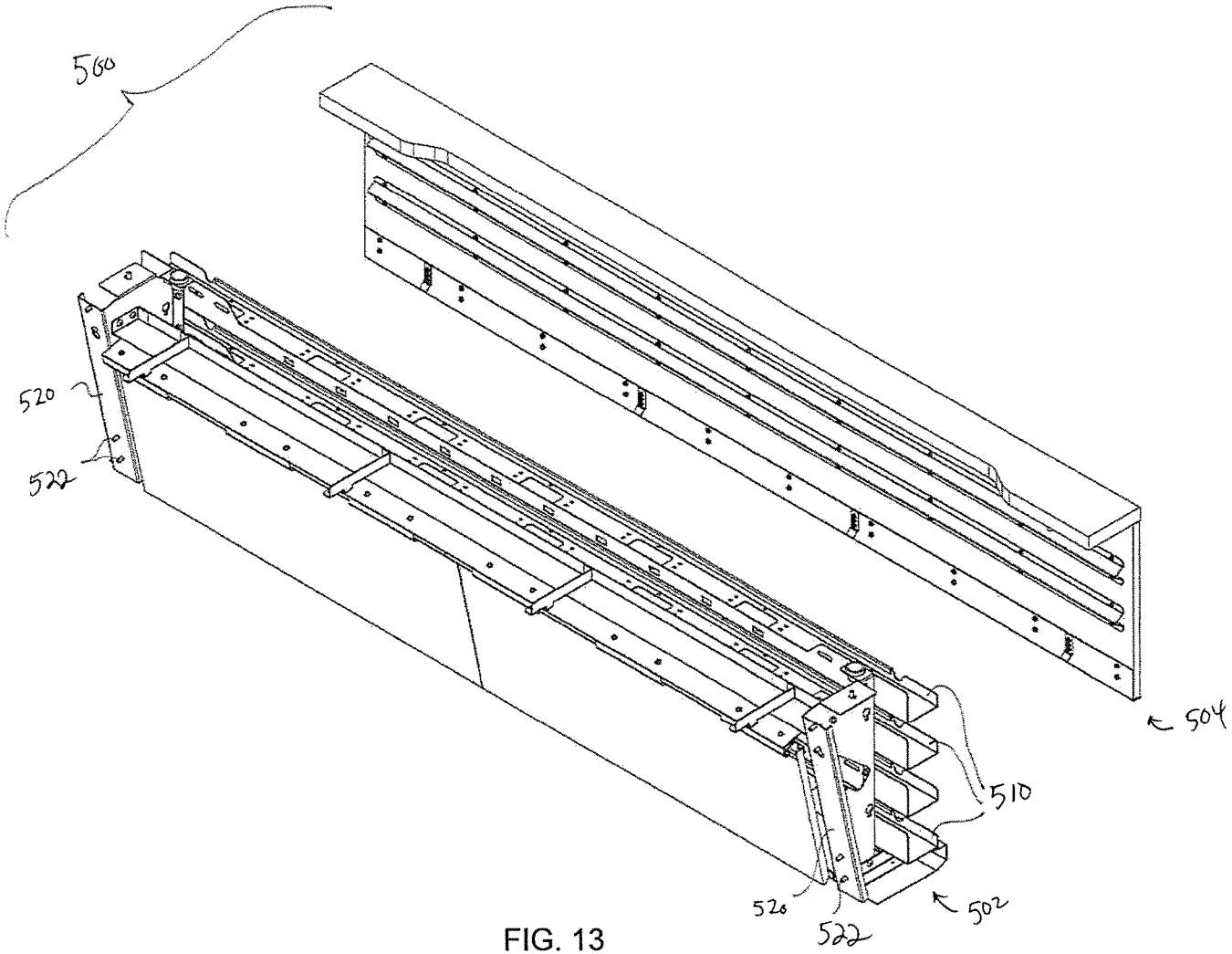
FIG. 13 is an exploded view of a cable management module of the console shown in FIG. 9.
Figure 14A:
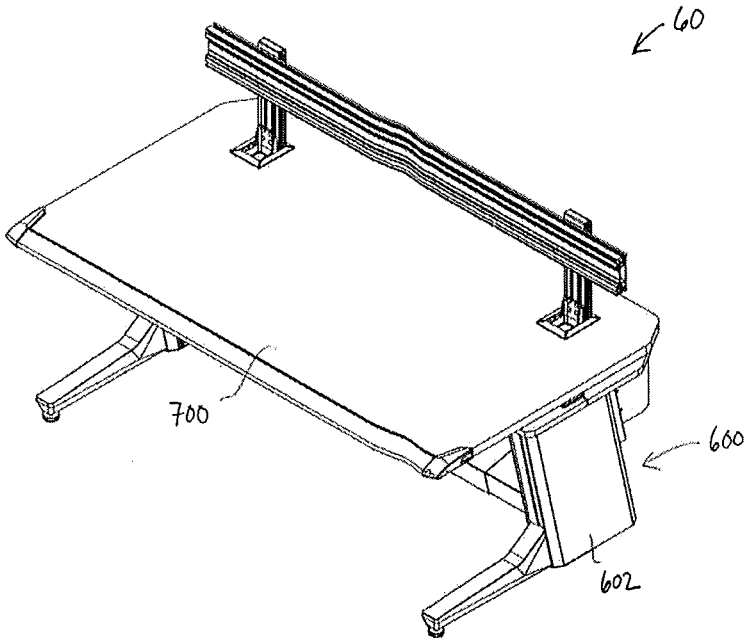
FIG. 14A is a front elevated perspective view of a third embodiment of a console according to the present disclosure having a height adjustable work surface.
Figure 14C:
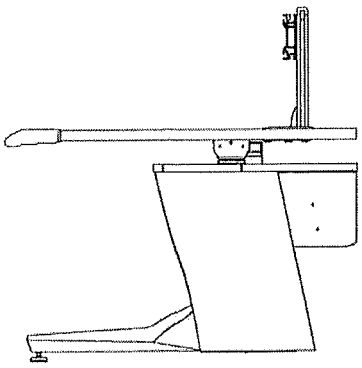
FIG. 14C is a side view of the console shown in FIG. 14A.
Figure 14D:
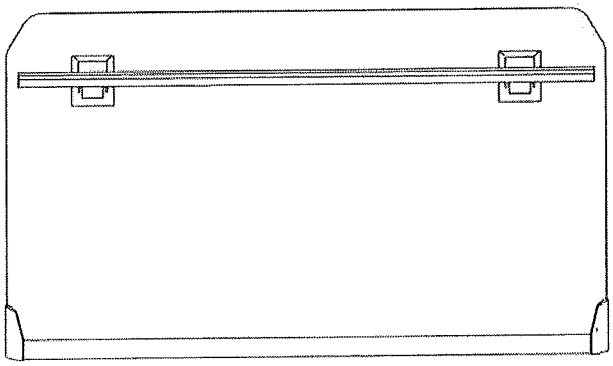
FIG. 14D is a top view of the console shown in FIG. 14A.
Figure 14B:
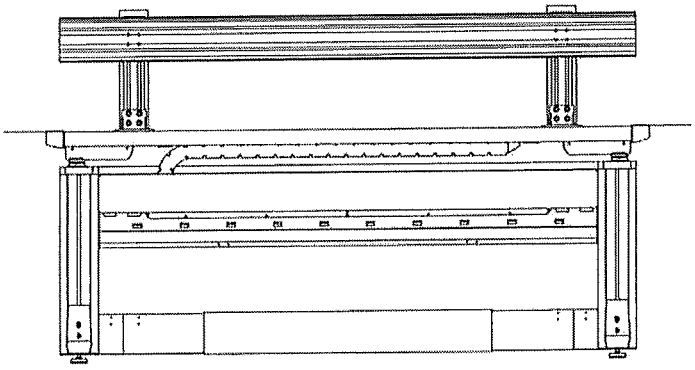
FIG. 14B is a rear view of the console shown in FIG. 14A.

In at least another embodiment, in place of or in addition to second arms 360, support structure 300 may comprise an enhanced cable management module 500, as shown in FIGS. 9A through 10A. Cable management module 500 is also shown in isolation in FIG. 13.

Module 500 may provide cable management as well as other features for the console 50. Having reference to FIG. 13, cable management module 500 may comprise a module assembly 502, which may include one or more cable trays 510. The ends of cable trays 510 may be open to allow cabling to run between two or more consoles 50 when they are place in a side-to-side relationship. In addition, cable assembly 502 may include attachment hardware for connection to legs 502 of a console 50. The attachment hardware may be any suitable type of hardware, such as bearing surfaces 520 and fasteners or other connection features 522, which may cooperate with corresponding structure on leg frames 304.

Cable management module 500 may also include a cover 504 to provide selective access to module assembly 502, such as cable trays 510. Cover may be releasably connectable to module assembly 502, or in other embodiments may be slidingly or pivotally connectable to assembly 502.

The present disclosure is further directed to a console having one or more height adjustable work surfaces. This type of console may be referred to as a "sit-stand" console as a work surface may be selectively height adjusted for sitting and standing configurations. However the term "sit-stand" is also used generally herein to refer to all embodiments that have one or more height adjustable work surfaces or other structures.

An embodiment of a sit-stand console 60 is shown in FIG. 14A to FIG. 16B.

Sit-stand console 60 may have several similarities to previously described embodiments and embodiments shown in FIGS. 1 to 13. Therefore these similarities will not be described in detail.

Figure 15A:
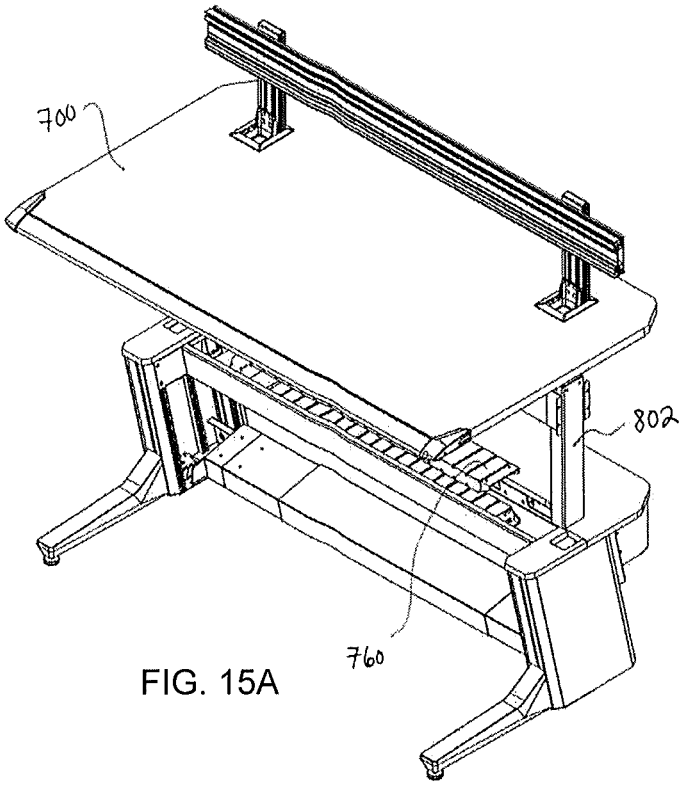
FIG. 15A is a front partial exploded view of the console shown in FIG. 14A with the work surface shown above and separately from support structure.
Figure 15C:
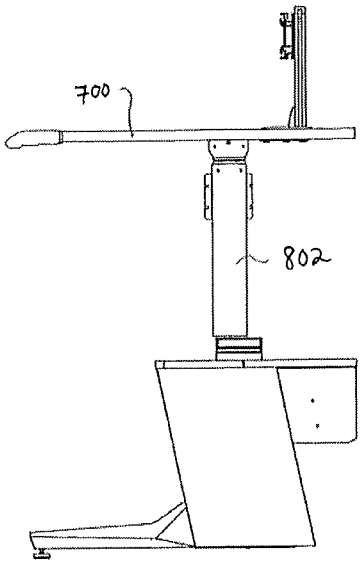
FIG. 15C is a side partial exploded view of the console shown in FIG. 14A with the work surface shown above and separately from support structure.
Figure 15B:
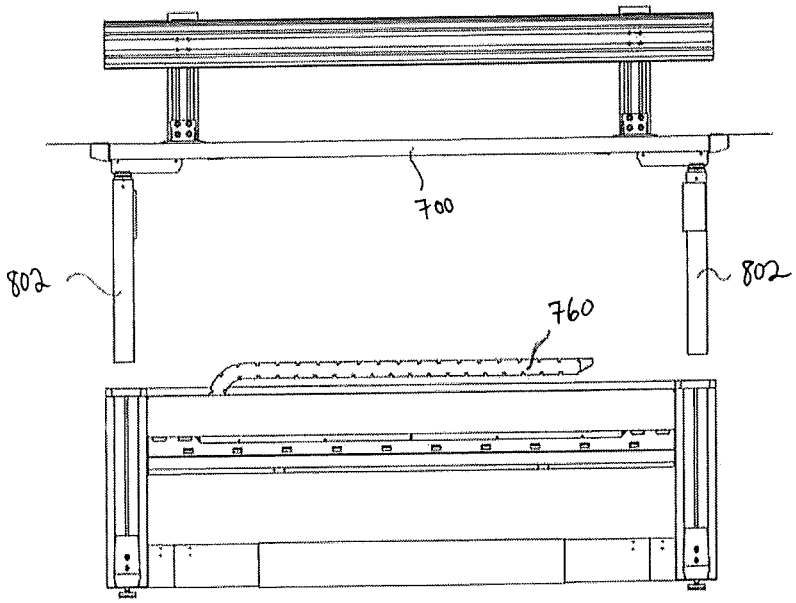
FIG. 15B is a rear partial exploded view of the console shown in FIG. 14A with the work surface shown above and separately from support structure.

FIGS. 14A to 14D show console 60 with support structure 600, and first work surface 700 in a lowered position. FIGS. 15A to 15C are partially exploded views of console 60 with work surface 700 shown above and separately from support structure 600 thereby fully exposing support columns 802. Therefore unlike some of the previously described embodiments, in sit-stand console 60, first work surface 700 is supported by movable support columns 802 instead of by first support arms or by leg frames.

Figure 18A:
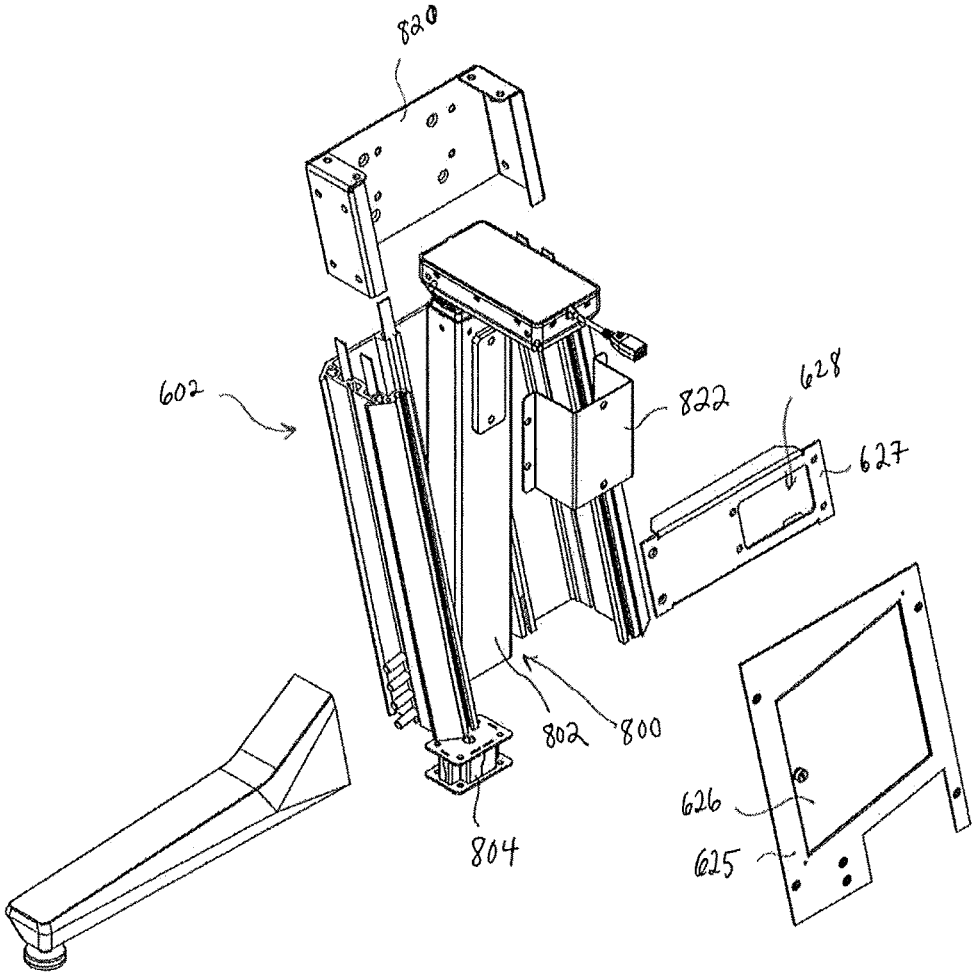
FIG. 18A is an exploded view of the console leg of the console of FIG. 14A.
Figure 18B:
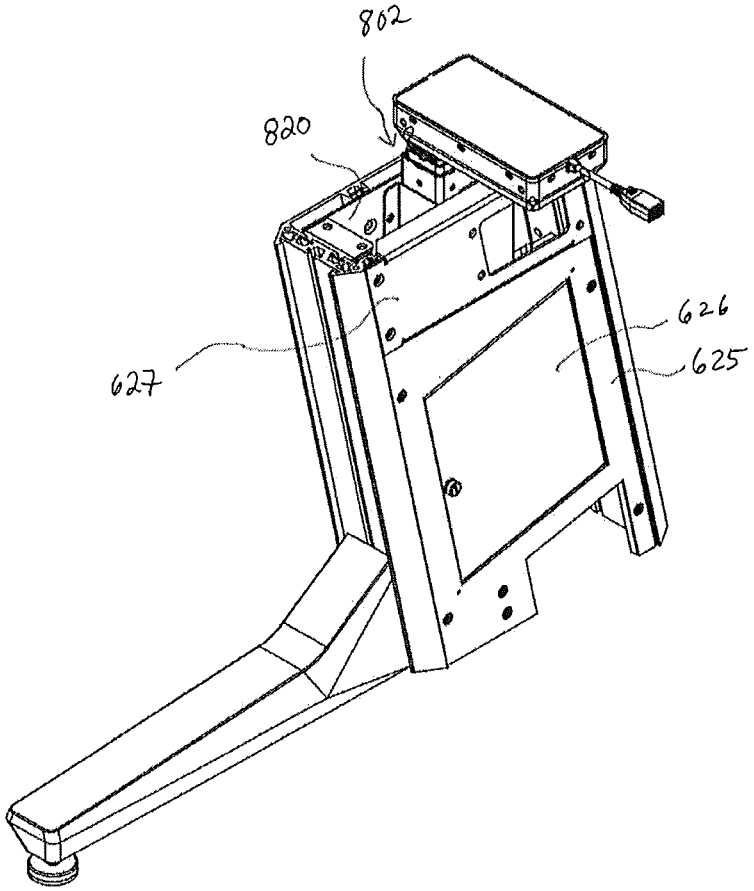
FIG. 18B is a side perspective view of the inside of the console leg of FIG. 18A.

FIGS. 18A and 18B show a leg 602 of an embodiment of the present console comprising parts of a lift assembly. With reference to FIG. 18A, support columns 802 may form part of a lift assembly 800 that may be disposed at or at least partially within one or both legs 602 of support structure 600. Lift assembly 800 may comprise at least one actuator (not shown) for selectively raising and lowering support columns 802 to change the distance between first work surface 700, or another structure in addition to or in place of work surface 700, and legs 602. An actuator may be positioned at least partially within support column 802, or alternatively to the exterior of column 802. In addition, one or more actuators may be any suitable type of actuator, including an electric actuator or a manual actuator. In addition, one or more electric actuators may be controlled in any suitable way, for example by one or more buttons or via computer.

Support column 802 may be supported about leg 602 in any suitable way. For example, an upper lift assembly bracket 820 may be secured at the top region of leg 602. Support column brace 822 may extend around support column 822 to help retain support column 802 in position in leg 602. Brace 822 may be securable to bracket 820 by bolts or other suitable means. In the embodiment shown in FIG. 18A, support column 802 is a telescopic column and brace 822 engages the outer most column member. In addition, lift assembly 800 may comprise a support column base 804 for supporting the support column 802.

In addition, leg 602 may also comprise cover 625, which may include door 626, as well as upper cover 627 defining an opening 628 corresponding to an upper raceway (not shown) of the console.

Figure 17A:
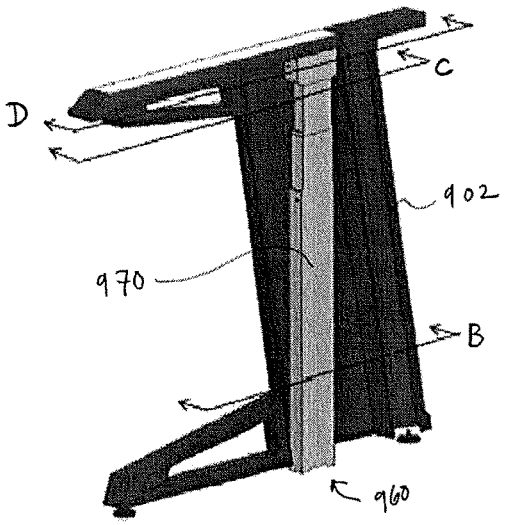
FIG. 17A is a cutaway view of a console leg of an embodiment of the present disclosure.
Figure 17B:
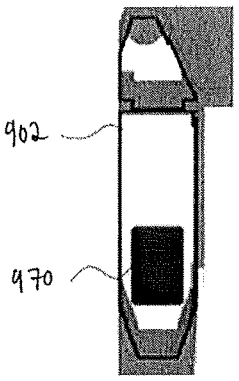
FIG. 17B is a cross sectional view of the console leg taken along the plane indicated by arrow B in FIG. 17A.
Figure 17C:
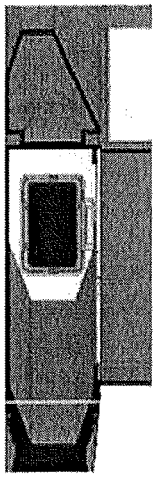
FIG. 17C is a cross sectional view of the console leg taken along the plane indicated by arrow C in FIG. 17A.
Figure 17D:
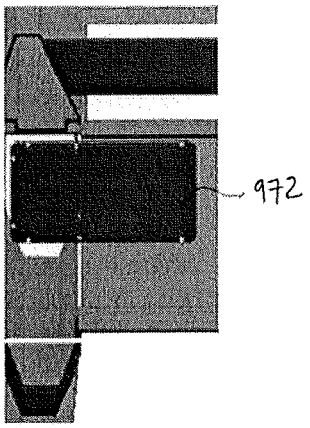
FIG. 17D is a cross sectional view of the console leg taken along the plane indicated by arrow D in FIG. 17A.

FIG. 17A shows a cutaway view of a leg frame of an embodiment of a sit-stand console having a lift assembly 960 disposed within leg 902. Lift assembly 960 is shown as having a telescoping support column 970, although any other suitable type of mechanism may be used. Lift assembly 960 may be manually or automatically powered. FIGS. 17B, 17C and 17D show cross-sectional views taken along arrows B, C and D shown in FIG. 17. FIG. 17D shows a plate or base 972 that may be positioned at the top of support column 970 for connecting to a work surface or other structure that is to be raised or lowered using the lift assembly.

Figure 16A:
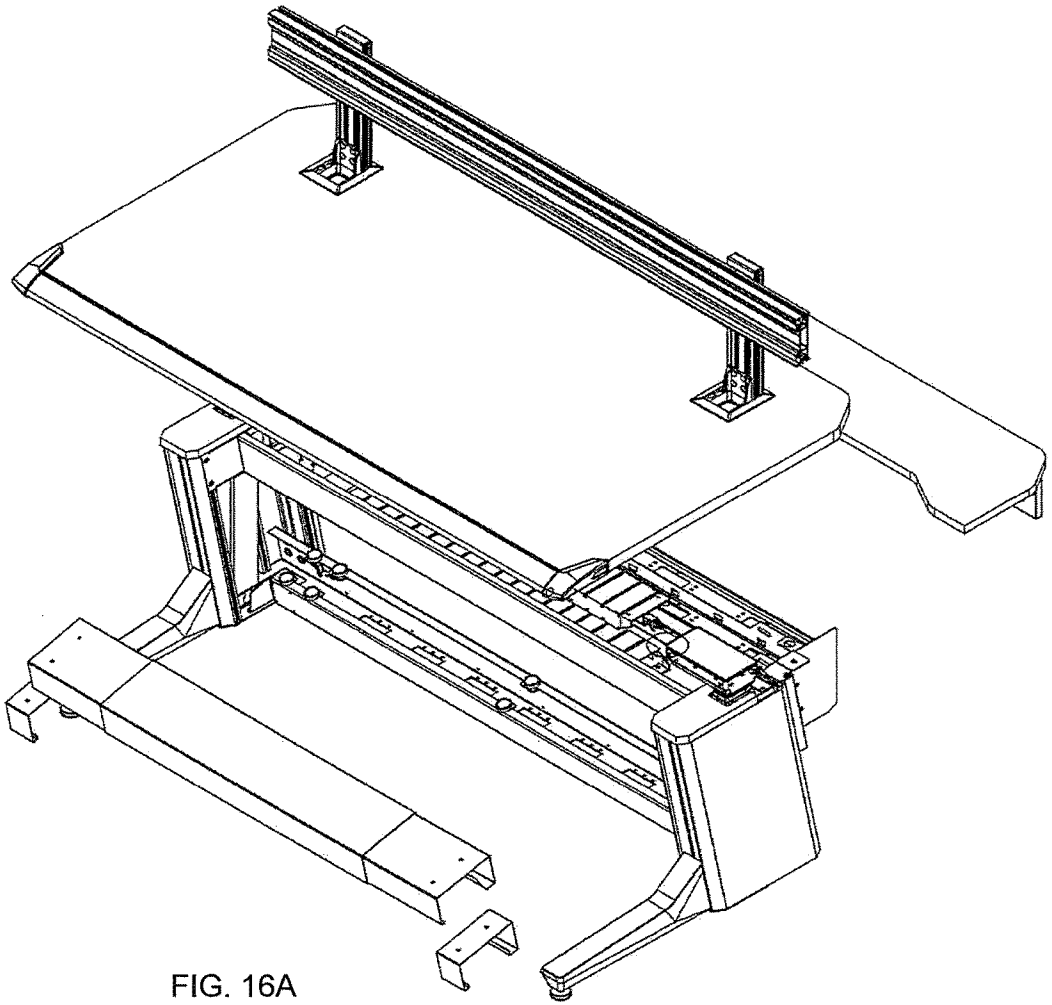
FIG. 16A is a front partial exploded view of the console shown in FIG. 14A.
Figure 16B:
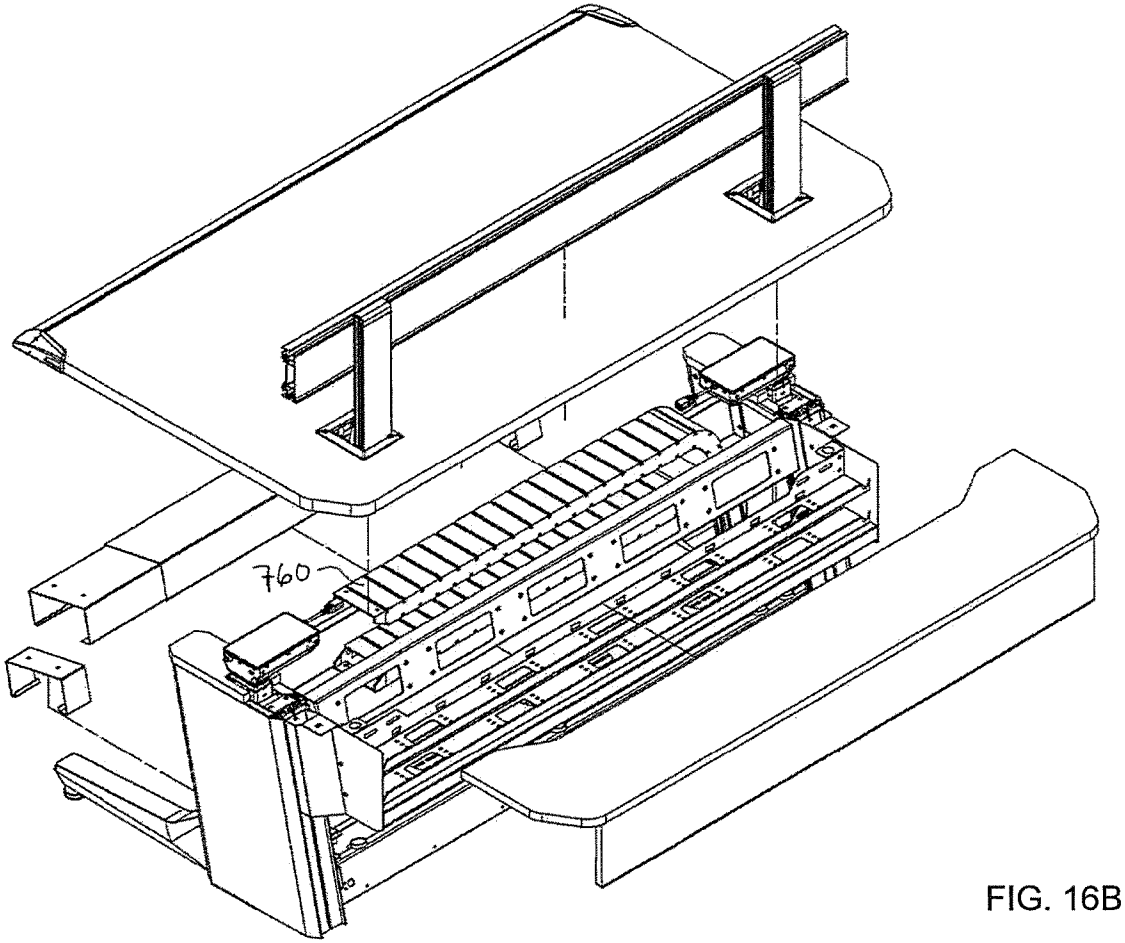
FIG. 16B is a rear partial exploded view of the console shown in FIG. 14A.

Furthermore, sit-stand console 60 may comprise means for managing wires and cabling as work surface 700 is raised and lowered. For example, as best shown in FIGS. 15B, 15C and 16B, console 60 may include at least one flexible cable harness 760. Harness 760 may extend between support structure 600 and first work surface 700 to manage and protect cabling in the harness as the work surface is moved up and down.

The structure, features, accessories, and alternatives of specific embodiments described herein and shown in the Figures are intended to apply generally to all of the teachings of the present disclosure, including to all of the embodiments described and illustrated herein, insofar as they are compatible. In other words, the structure, features, accessories, and alternatives of a specific embodiment are not intended to be limited to only that specific embodiment unless so indicated.

Furthermore, additional features and advantages of the present disclosure will be appreciated by those skilled in the art.

In addition, the embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed:

1. A support structure for supporting a work surface, the support structure comprising:

two spaced apart leg frames, each defining a respective interior space;

a frame stringer extending between the leg frames and into the interior space of each leg frame;

for each said leg frame:

a respective frame stringer bracket mounted to the leg frame in the interior space of the leg frame, the frame stringer bracket securing the frame stringer to the leg frame; and a respective first support, mounted to a first side of the leg frame, for supporting the work surface; wherein the frame stringer bracket defines a recess or opening that provides clearance for mounting hardware that secures the first support to the leg frame, wherein, for each said leg frame, the first support is selectively mountable to the leg frame at various positions along the leg frame.

2. The support structure of claim 1, wherein each said leg frame defines a respective passageway in its interior space to allow for the passage of cabling therethrough.

3. The support structure of claim 1, further comprising, for each said leg frame, a respective second support for supporting a second work surface, the second support being mounted to a second side of the leg frame that is opposite to the first side of the leg frame.

4. The support structure of claim 3, wherein the second support is selectively mountable to the leg frame at various positions along the leg frame.

5. The support structure of claim 1, wherein each said leg frame comprises a respective second side opposite to the first side of the leg frame, and the support structure further comprises a cable management module mounted to the second side of each said leg frame.

6. The support structure of claim 5, wherein the cable management module comprises at least one cable tray extending along a length of the cable management module.

7. A support structure for supporting a plurality of objects, the support structure comprising: at least one leg frame, each having respective first and second ends and at least one side and defining a respective interior space, each said at least one leg frame comprising at least one respective outer channel in said at least one side and at least one respective inner channel in the at least one side, the at least one outer channel and the at least one inner channel extending at least partially between the first and second ends;

for each said at least one leg frame, at least one respective outer alignment device receivable into the at least one outer channel and at least one respective inner alignment device receivable into the at least one inner channel, the at least one outer alignment device defining at least one respective outer mounting hole, and the at least one inner alignment device defining at least one respective inner mounting hole, wherein, when the at least one outer alignment device is positioned within the at least one outer channel, the at least one outer mounting hole cooperates with respective mounting hardware to provide alignment of at least one object of the plurality of objects to be mounted externally to the leg frame, and when the at least one inner alignment device is positioned within the at least one inner channel, the at least one inner mounting hole cooperates with respective mounting hardware to provide alignment of at least one other object of the plurality of objects to be mounted within the interior space of the leg frame.

8. The support structure of claim 7, wherein the at least one inner alignment device and the at least one outer alignment device are in the form of alignment strips.

9. The support structure of claim 7, wherein the plurality of objects comprise at least one of: at least one support for at least one work surface; and at least one bracket.

10. The support structure of claim 9, wherein the at least one support for at least one work surface comprises a first support for a first work surface.

11. The support structure of claim 10, wherein the at least one support for at least one work surface further comprises a second support for a second work surface.

12. The support structure of claim 9, wherein the at least one bracket includes at least one of: a frame stringer bracket; and a cable raceway bracket.

13. A support structure for supporting a work surface, the support structure comprising:

two spaced apart leg frames, each defining a respective interior space;

a frame stringer extending between the leg frames and into the interior space of each leg frame;

for each said leg frame:

a respective frame stringer bracket mounted to the leg frame in the interior space of the leg frame, the frame stringer bracket securing the frame stringer to the leg frame;

a respective first support, mounted to a first side of the leg frame, for supporting the work surface, wherein the frame stringer bracket defines a recess or opening that provides clearance for mounting hardware that secures the first support to the leg frame; and for each said leg frame, a respective second support for supporting a second work surface, the second support being mounted to a second side of the leg frame that is opposite to the first side of the leg frame.

14. The support structure of claim 13, wherein each said leg frame defines a respective passageway in its interior space to allow for the passage of cabling therethrough.

15. The support structure of claim 13, wherein the second support is selectively mountable to the leg frame at various positions along the leg frame.

16. The support structure of claim 13, wherein each said leg frame comprises a respective second side opposite to the first side of the leg frame, and the support structure further comprises a cable management module mounted to the second side of each said leg frame.

17. The support structure of claim 16, wherein the cable management module comprises at least one cable tray extending along a length of the cable management module.

* * * * *